US010598185B2

(12) United States Patent
Henny et al.

(10) Patent No.: US 10,598,185 B2
(45) Date of Patent: Mar. 24, 2020

(54) SPIRAL PUMP AND MANUFACTURING METHOD THEREFOR

(71) Applicant: AQYSTA HOLDING B.V., Delft (NL)

(72) Inventors: Frederik Leonardus Henny, The Hague (NL); Lennart Thore Budelmann, Delft (NL); Pratap Thapa, Delft (NL)

(73) Assignee: AQYSTA HOLDING B.V. (NL)

( * ) Notice: Subject to any disclaimer, the term of this patent is extended or adjusted under 35 U.S.C. 154(b) by 950 days.

(21) Appl. No.: 15/029,928

(22) PCT Filed: Oct. 16, 2014

(86) PCT No.: PCT/NL2014/050721
§ 371 (c)(1),
(2) Date: Apr. 15, 2016

(87) PCT Pub. No.: WO2015/057069
PCT Pub. Date: Apr. 23, 2015

(65) Prior Publication Data

US 2016/0238017 A1 Aug. 18, 2016

(30) Foreign Application Priority Data

Oct. 18, 2013 (NL) ..... 2011650

(51) Int. Cl.
*F04D 29/22* (2006.01)
*F04D 13/04* (2006.01)
*F04D 29/24* (2006.01)

(52) U.S. Cl.
CPC ..... *F04D 29/225* (2013.01); *F04D 13/04* (2013.01); *F04D 13/043* (2013.01); *F04D 29/245* (2013.01)

(58) Field of Classification Search
CPC ..... F04D 13/04; F04D 13/043; F04D 29/225; F04D 29/245
See application file for complete search history.

(56) References Cited

U.S. PATENT DOCUMENTS 2,113,213 A 4/1938 Leonard
2,568,903 A 9/1951 Vassar
(Continued)

FOREIGN PATENT DOCUMENTS

CN 86106587 4/1987
CN 2086316 10/1991
(Continued)

OTHER PUBLICATIONS

PCT International Search Report and Written Opinion, PCT International Application No. PCT/NL2014/050721, dated Feb. 9, 2015.

*Primary Examiner* — Justin D Seabe
*Assistant Examiner* — Cameron A Corday
(74) *Attorney, Agent, or Firm* — McDonnell Boehnen Hulbert & Berghoff LLP.

(57) ABSTRACT

The present invention relates to a spiral pump, including a support body; at least one or more substantially rigid rotary parts that are rotatable relative to said support body, wherein said one or more rotary parts comprise at least one integrated spiral fluid channel that has an inlet for receiving fluid arranged at or near the outer radial wall of said one or more rotary parts and an outlet for discharging fluid at an increased pressure at or near its rotary axis; wherein a fluid passage, configured for passing fluid at the increased pressure from inside the one or more rigid rotary parts to outside the one or more rigid rotary parts, is arranged at or near the rotary axis; and drive means for rotatably driving the one or more rotary parts. The invention further relates to a manufacturing method for such a spiral pump.

14 Claims, 9 Drawing Sheets

(56) References Cited

U.S. PATENT DOCUMENTS

Figure 1:
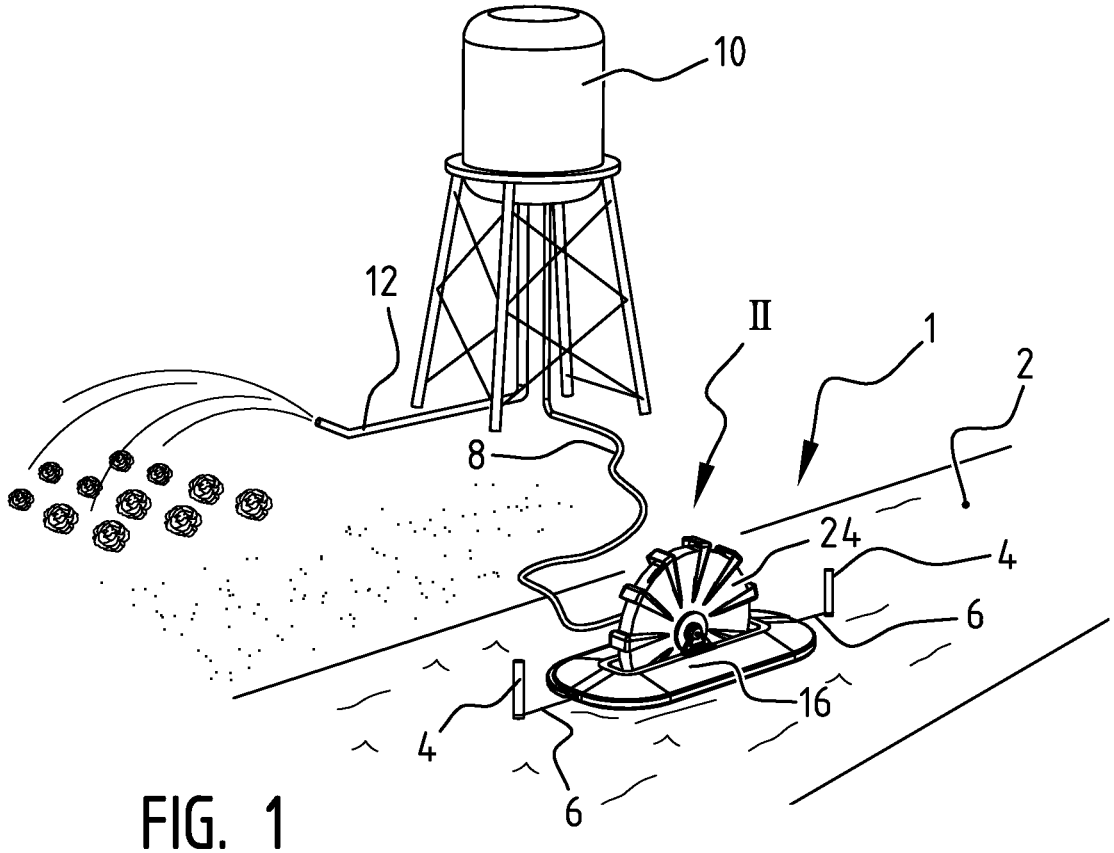

| | | | | |
|---|---|---|---|---|
| 2,906,447 | A | 9/1959 | Seed | |
| 5,346,374 | A * | 9/1994 | Guttinger ..... | F04C 29/04<br>418/101 |

FOREIGN PATENT DOCUMENTS

| | | |
|---|---|---|
| DE | 92 14 695 U1 | 12/1992 |
| DE | 10231008 | 1/2004 |
| EP | 2 562 423 A1 | 2/2013 |
| FR | 2 822 891 A1 | 10/2002 |

* cited by examiner

SPIRAL PUMP AND MANUFACTURING METHOD THEREFOR

CROSS REFERENCE TO RELATED APPLICATIONS

The present application is a national stage entry of PCT/NL2014/050721, filed 16 Oct. 2014, and claims priority to NL 2011650 filed 18 Oct. 2013. The full disclosures of NL 2011650 and PCT/NL2014/050721 are incorporated herein by reference.

The present invention relates to a spiral pump, and a manufacturing method therefor.

Spiral pumps are known for lifting liquid from a low level to a higher level, and are for example used for irrigation. Conventional spiral pumps normally comprise a flexible tube that is arranged in a spiral shape around a rotary part. The inlet of the spiral fluid channel alternately takes up fluid of the lower portion of a revolution of the rotary part, and a charge of air on the upper portion of each revolution of the rotary part. In this way, successive charges of fluid and air enter the spiral fluid channel. Upon rotation of the spiral, the fluid taken up is gradually forced toward the outlet. While the fluid flows from one convolution to the other, the charge of air in between the two charges of fluid will be compressed. The air compressed in each convolution has a tendency to expand in the rotation of the rotary part into the next convolution and assists in driving the preceding charge of fluid before it, thus providing a pneumatic pumping action and causing a pressure build up. Using this pressure, fluid can be lifted from a low level to a higher level.

Conventional spiral pumps comprise many parts, including tubes, a drum and axle, making for relatively high total weight of the spiral pump. Both for logistics and efficiency, a reduced weight of the spiral pump is beneficial.

A further disadvantage of conventional spiral pumps is their limited potential for scalability or mass production.

There is also a need for an improved spiral pump that has improved reliability and can therefore be used in remote and isolated places, where maintenance is difficult, e.g. due to lack of qualified maintenance personnel.

An object of the present invention is therefore to provide a spiral pump, that is improved relative to the prior art and wherein at least one of the above stated problems is obviated.

Said object is achieved with the spiral pump according to the present invention, comprising:

- a support body;
- at least one or more substantially rigid rotary parts that are rotatable relative to said support body, wherein said one or more rotary parts comprise at least one integrated spiral fluid channel that has an inlet for receiving fluid arranged at or near the outer radial wall of said one or more rotary parts and an outlet for discharging fluid at an increased pressure at or near its rotary axis;
- wherein a fluid passage, configured for passing fluid at the increased pressure from inside the one or more rigid rotary parts to outside the one or more rigid rotary parts, is arranged at or near the rotary axis; and
- drive means for rotatably driving the one or more rotary parts.

Because the spiral fluid channel is a course integrated within a rigid body, it can be optimized regarding exact positioning, curvature, a cross section that might have a varying shape and dimension over the course, etc. This allows for a high level of customization to the specific requirements for a desired application of the spiral pump.

A single rigid rotary part incorporating an internal spiral fluid channel may be formed by an additive manufacturing technique, also called 3D printing. 3D printing would furthermore allow very complex shapes for the fluid channel. Moulding techniques, such as twin-sheet vacuum forming and may also be used.

Furthermore, a rigid body provides a more robust spiral fluid channel than a flexible tube would offer, moreover because a tube that is flexible enough to bend, is also very likely to stretch in annular direction when the pump increases the pressure of the fluid.

A compact design of the spiral pump is obtained if according to a preferred embodiment, said spiral fluid channel comprises at least two convolutions that are arranged in a plane that is substantially transverse to the rotary axis.

According to a further preferred embodiment, the outer radial wall of the rotary part has an outer radius $r_o$, and wherein the convolutions are at least arranged in the area between said outer radial wall of the rotary part and a radius of half the outer radius $r_o$. It is explicitly noted that 'at least' should be interpreted in the sense that the convolutions are arranged in the area between the outer radius ($r_o$) and half the outer radius ($\frac{1}{2} r_o$), and may also extend at a radius less than half the outer radius ($<\frac{1}{2} r_o$). The inlet of the spiral fluid channel alternately takes up fluid on the lower portion of a revolution of the rotary part, and a charge of air on the upper portion of each revolution of the rotary part. In this way, successive charges of fluid and air enter the spiral fluid channel. At the first convolution of the spiral fluid channel, it's filled with fluid for about half of the convolution, and the remainder of the convolution is charged with air. Upon rotation of the spiral, the fluid flows from one convolution to the other, thereby compressing the charge of air in between two successive charges of fluid. In order to take account for the substantially incompressible behavior of most fluids, the convolutions are at least arranged in the area between the outer radial wall of the rotary part and a radius of half this outer radius, especially when the cross section has a substantially constant size over the length of the spiral fluid channel. In this way, the fluid can take up almost a full convolution at a radius of half or less of the outer radius, whereas the gas in between two successive charges of fluid is highly compressed.

According to a further preferred embodiment, at least one further convolution of the fluid channel is arranged in the radial distance between half the outer radius $r_o$ and the center of the rotary part. In this way, overall product size may be further reduced while maintaining a desired volume- and pressure capacity, resulting in a compact spiral pump that requires a reduced amount of material for a pump of a certain capacity.

According to a further preferred embodiment, the rotary part comprises at least two substantially rigid sub parts. In this way, two or more rigid parts can be combined in a modular design, thereby providing a pump that is scalable to the specific needs. Each sub part might comprise an individual integrated spiral fluid channel. In a preferred embodiment where two sub parts are used, they comprise mirrored parts.

If, according to an even further preferred embodiment, two neighboring mating sub parts in an assembled state together enclose the fluid channel at their contact surface, the rotary parts can be assembled from separate sub parts that do not comprise internal openings. Sub parts that do only comprise one or more recesses at their outer surface, and that do not comprise internal openings, may be injection moulded, or fabricated by rotation moulding, injection moulding or (twin-sheet) vacuum forming. This allows the sub parts to be manufactured in mass production.

Furthermore, if an obstruction would enter the spiral fluid channel, it can be removed by taking the mating sub parts apart from each other. The spiral fluid channel can be fully opened when the two neighboring sub parts are taken apart for maintenance. In this way it is possible to remove obstructions that might get stuck in the fluid channel during use.

Although it is conceivable that the fluid channel is arranged on a radial surface of only of the two neighboring sub parts, the fluid channel is preferably formed by spiral shaped recesses arranged at mating radial sides of both neighboring sub parts of the rotary part. This allows the fluid channel to comprise a substantially rounded cross section, which is beneficial for the flow of fluid there through and is moreover less susceptible for getting obstructed. However, if an obstruction would enter the fluid channel, it can still be opened by taking the mating sub parts apart.

According to a further preferred embodiment, the substantially rigid rotary part comprises a pressure chamber at or near its rotary axis. If the rotary part comprises multiple spiral fluid channels which are with their outlet connected to the pressure chamber, said pressure chamber will provide a pressure equalization.

A spiral pump according to the previous embodiment preferably further comprises that the fluid passage is configured for passing fluid at the increased pressure from the pressure chamber to outside the rigid rotary part.

According to an even further preferred embodiment, the rigid rotary part is rotatably supported at both sides by support members. Even more preferably, the rotation movement of the rotary part relative to the support members is supported on hydrostatic bearings that are pressurized by a part of the pressurized fluid in the pressure chamber leaking out the pressure chamber via said bearings. Hydrostatic bearings have the advantage that they are lubricated by a substance readily available. There is no need for e.g. oil as lubrication, which would require seals and maintenance if a bearing fails. By providing hydrostatic bearings, the pump is more reliable to operate and can therefore be used at remote and isolated places, where maintenance is difficult.

According to an even further preferred embodiment, the spiral fluid channel has a substantially flattened cross section with a radial height h and a width w transverse thereto, wherein the radial height h is smaller than the width w. Such a flattened cross section allows more convolutions to be arranged within the available radial distance, and thus a higher pressure build up obtained by the spiral pump. As indicated before, the radial distance where the convolutions are arranged is preferably at least between the outer wall and half or less of the radius of said outer wall.

If, according to a still further preferred embodiment, the spiral fluid channel comprises a narrowing part wherein the cross section decreases in the flow direction, the pressure of the fluid is even further increased.

According to an even further preferred embodiment, the spiral fluid channel comprises a widening part wherein the cross section increases in the flow direction, and wherein said widening part is arranged downstream of the narrowing part in said spiral fluid channel. The cross section of the spiral fluid channel first decreases in the narrowing part before it eventually increases from its inlet towards its outlet in the widening part. An advantage of this increase, is that spillback of water is minimized Additionally, the increased volume of the convolution allows for an additional volume of water to be facilitated in that convolution, effectively allowing for adding one or multiple further windings that are positioned further inward than half of the radius $r_0$. If the widening part where absent, the effectiveness of such additional coils would be very limited due to the fact that the volume of water would fill such a convolution completely, hence not allowing additional pressure to be built efficiently due to spillback.

A still further preferred embodiment comprises a spiral fluid channel with one or more sections with internal projections. These internal projections according to a first aspect comprise longitudinal ribs, i.e. ribs extending in the flow direction, thereby directing the flow and preventing turbulence in the flow. Alternatively, according to a second aspect, one or more ribs are arranged at an angle relative to the flow direction, e.g. with a helical shape, thereby forcing the streaming fluid into a rotation.

According to an even further preferred embodiment, the spiral fluid channel in the direction away from its inlet divides into multiple fluid channels with a smaller cross sectional area. Such channels, that may be manufactured using an additive manufacturing technique as 3D printing, would provide a smaller cross section where the fluid is pressurized. In this way, turbulence of the pressurized flow can be limited or completely prevented.

According to a further preferred embodiment, said spiral pump comprises at least one further spiral fluid channel, wherein the spiral fluid channel and the further spiral fluid channel are connected in series by providing a fluid connection between an inner convolution at a first outlet radius of the spiral fluid channel and an outer convolution at a second inlet radius of the further spiral fluid channel, wherein the second inlet radius is larger than the first outlet radius. Fluid that is already pressurized in a first spiral fluid channel is fed back to an input of a further, second spiral fluid channel, which allows the already to some extend pressurized fluid to be pressurized even further. This allows the head of the pump to be increased significantly. Tests have indicated that a head increase of 70% is achievable.

According to a further preferred embodiment, the spiral pump further comprises a shaft that is rotatably connected to said support body, said shaft being at least partially hollow and comprising a fluid passage between the pressure chamber and the hollow part in order to form a fluid passage configured for passing fluid at the increased pressure from the pressure chamber to outside the rigid rotary part. Optionally, a shaft can be provided for supporting the rotary part of the spiral pump. This is especially useful for a spiral pump comprising a wide span, e.g. due to multiple rotary sub parts being combined into a large spiral pump.

According to a still further preferred embodiment, the support body of the spiral pump is a floating support body that is configured to be partially submerged in a fluid. In this way, the spiral pump floats on the water stream, and can therefore be easily placed and moved Although the drive means for driving the rotary parts might comprise a motor or a propeller with vanes, the drive means preferably comprise paddles arranged around or near the circumference of the one or more rotary parts itself. Although the blades might be attached to or even integrated with the rotary parts. It is remarked that they need not necessarily extend beyond the outer radius, i.e. the outer radial wall, of the rotary part(s). In this way the rotary parts might be rotated using a streaming fluid, e.g. when the spiral pump is arranged in a water stream. If the current of a water stream acting on the blades is used for rotating the rotary part, a simple drive means is provided that moreover uses a natural energy source.

The invention further comprises a method for manufacturing a rotary part for a spiral pump as described above, comprising a fabrication method using an additive manufacturing technique as 3D printing, or a moulding technique such as twin-sheet vacuum forming, rotational moulding or injection moulding.

Figure 2:
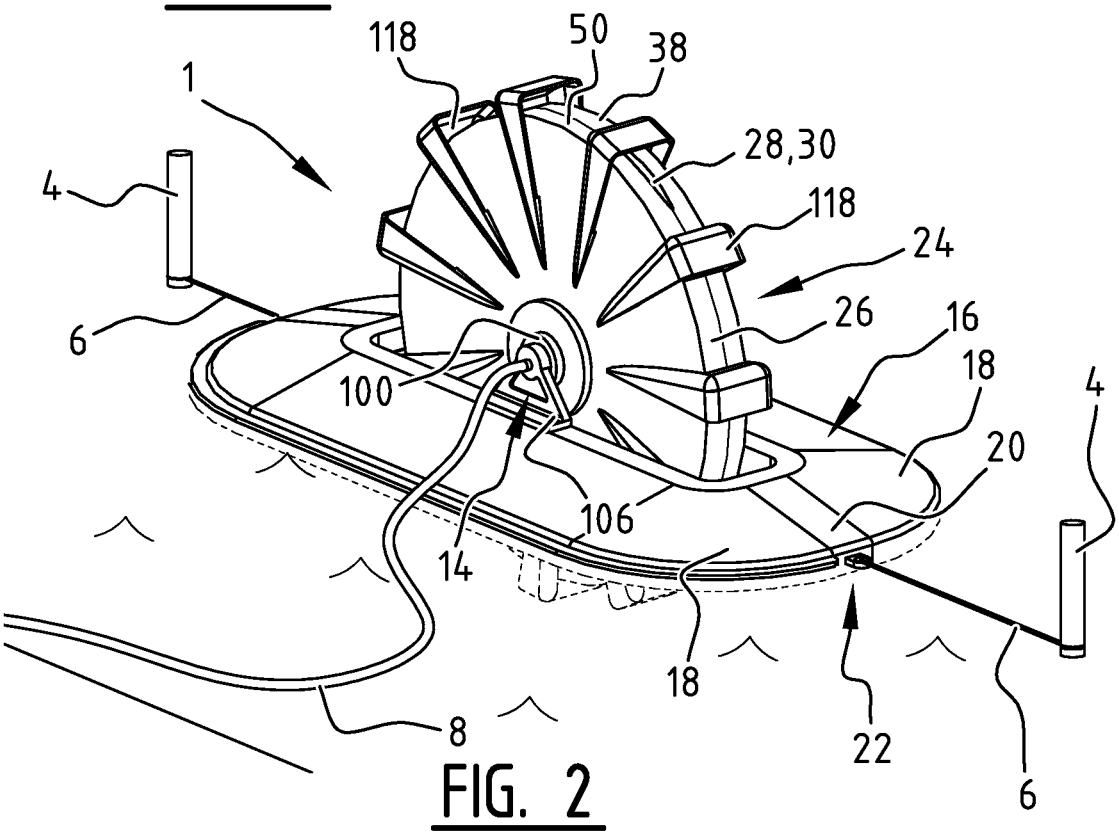
Figure 3:
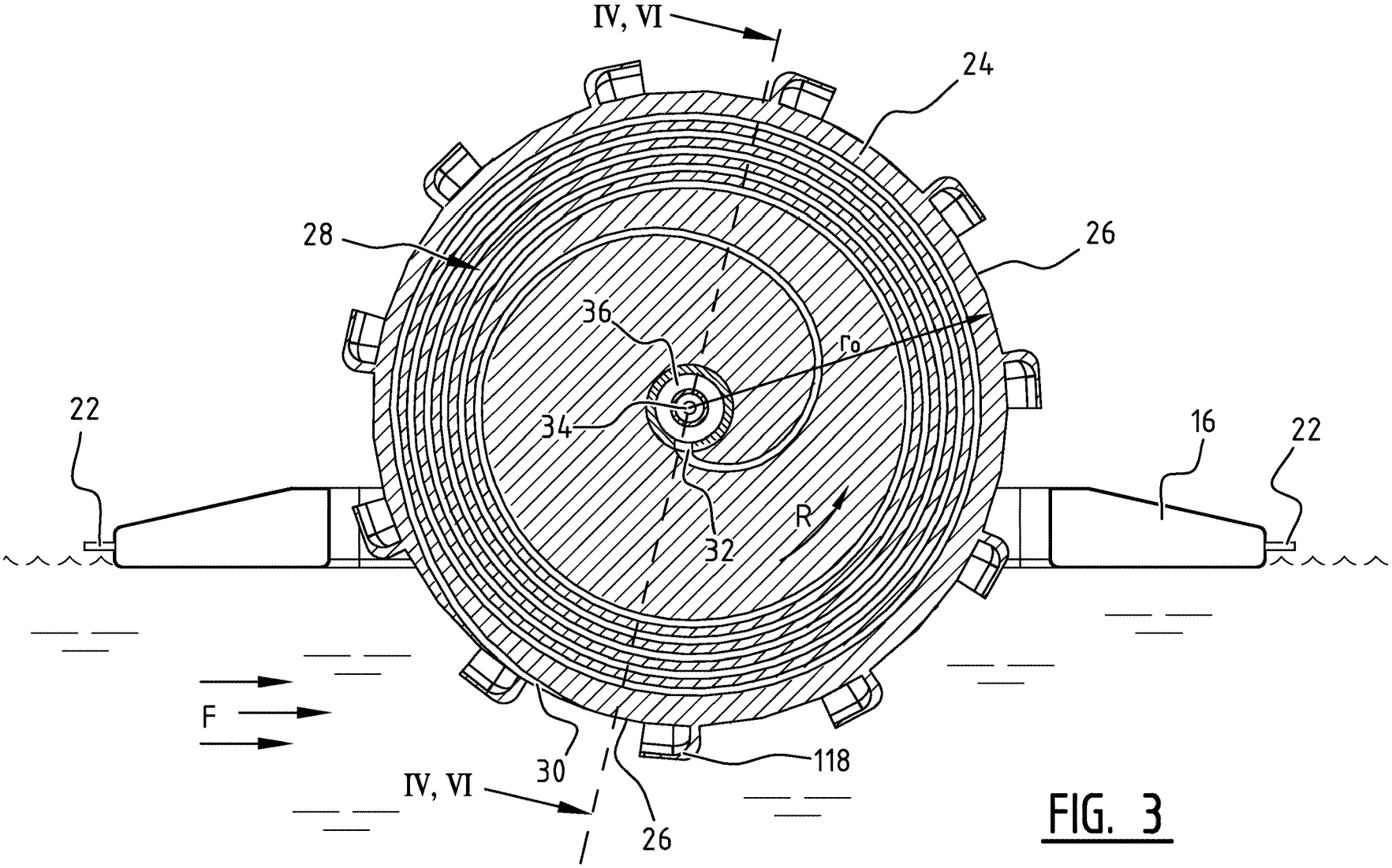
Figure 4:
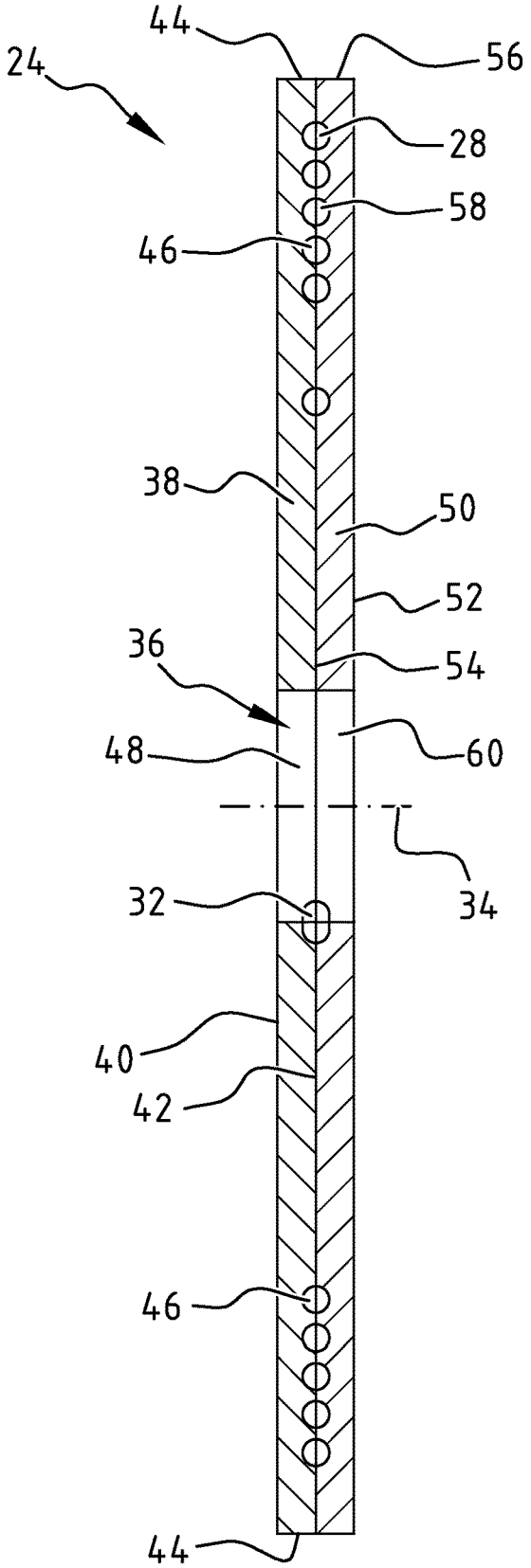
Figure 5:
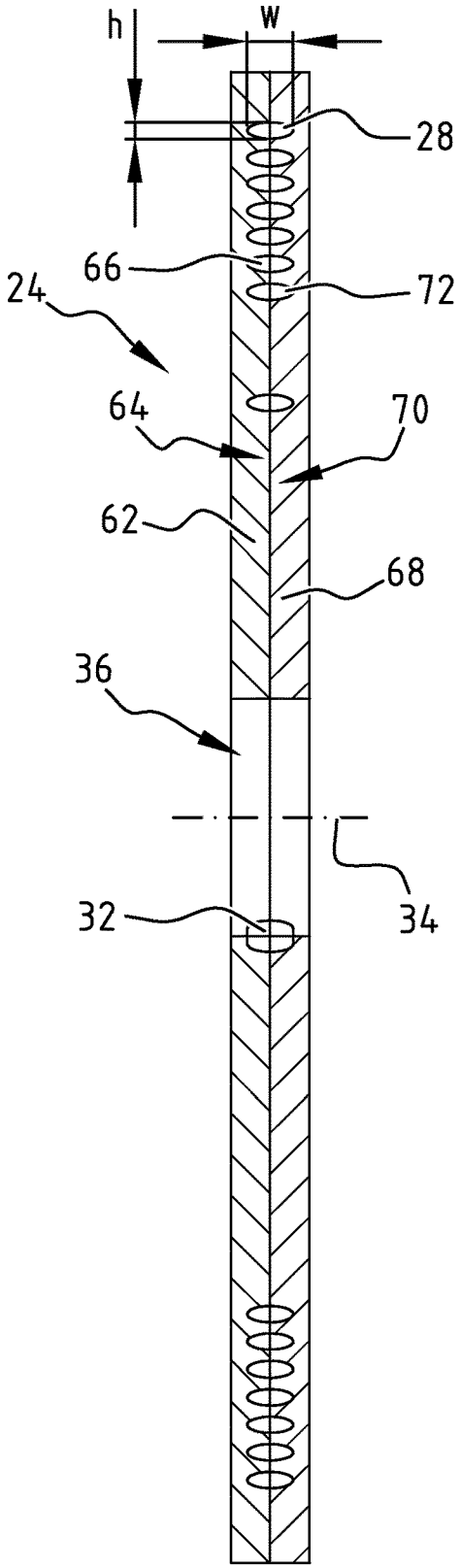
Figure 6:
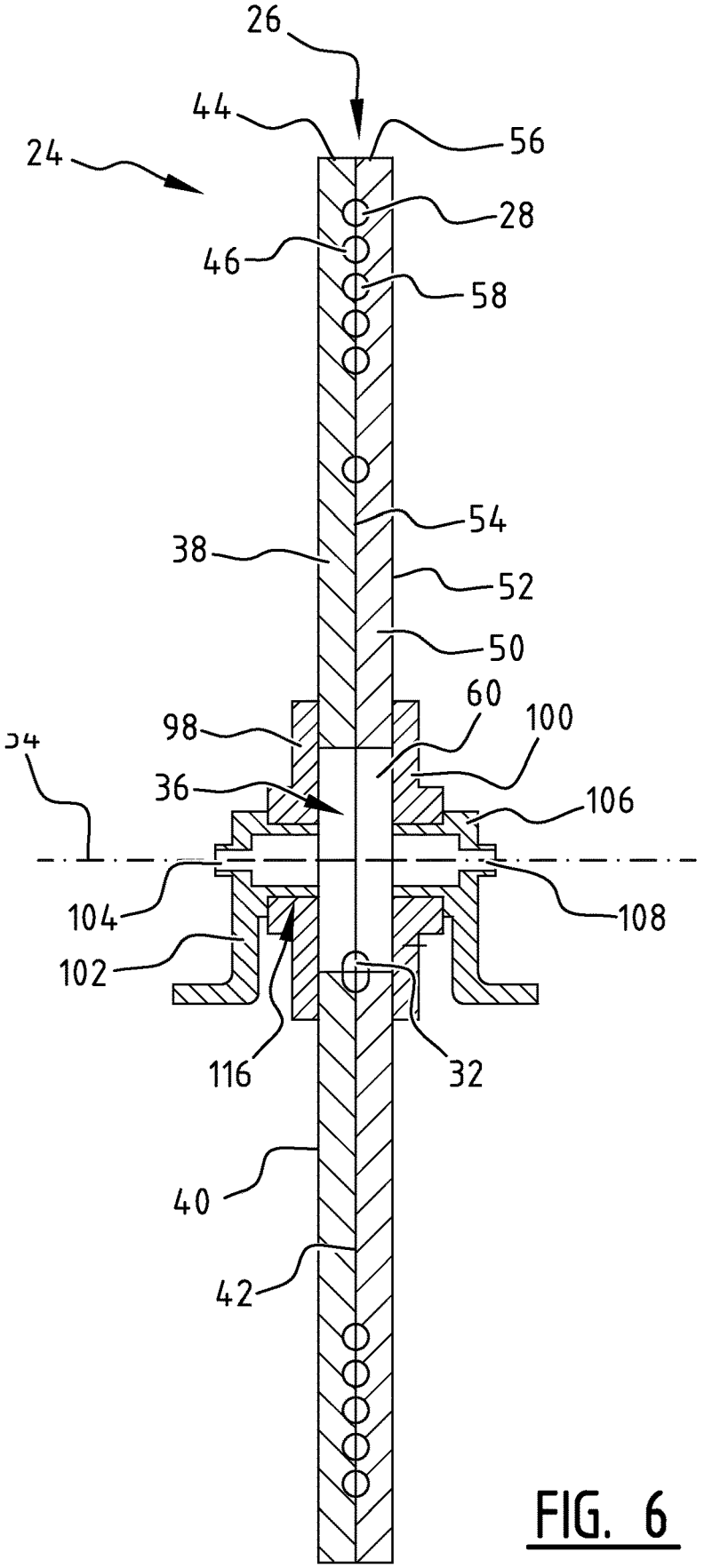
Figure 7A:
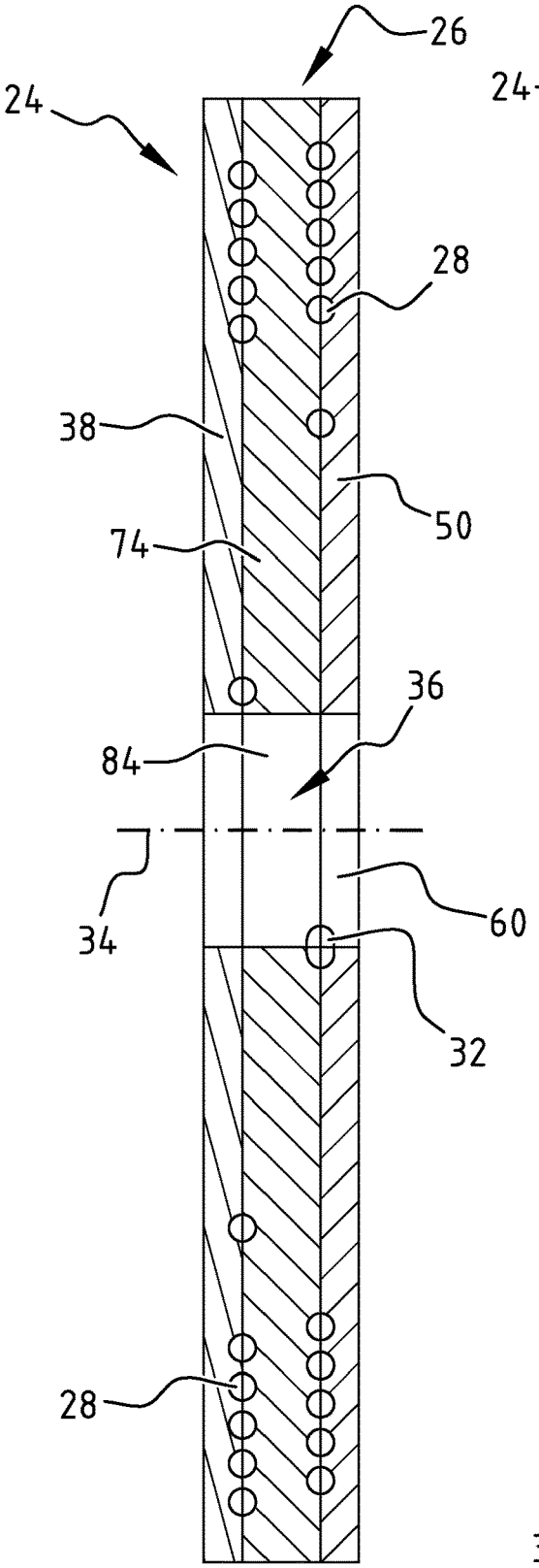
Figure 7B:
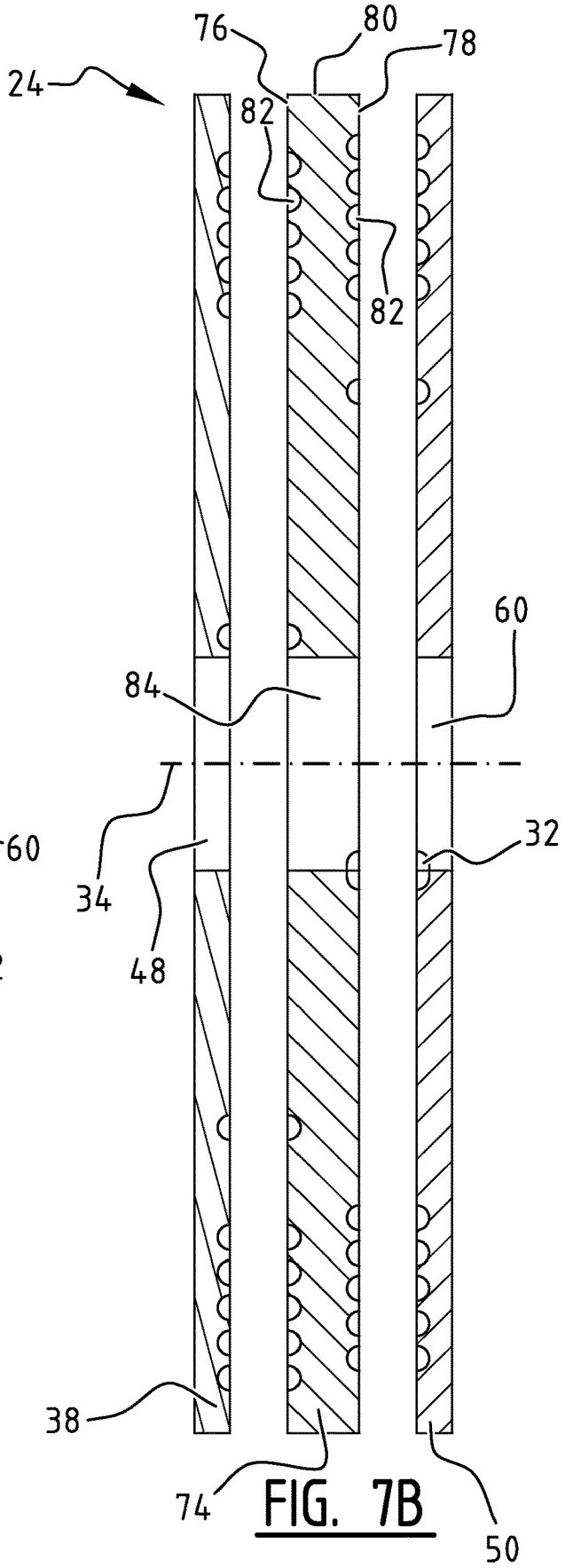
Figure 8:
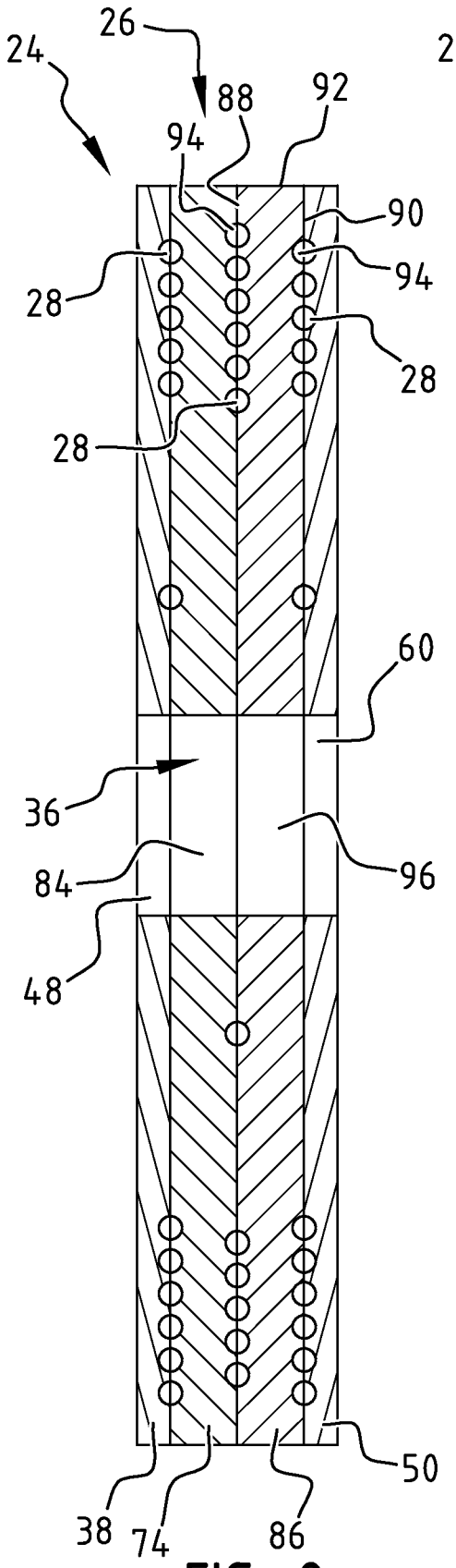
Figure 9:
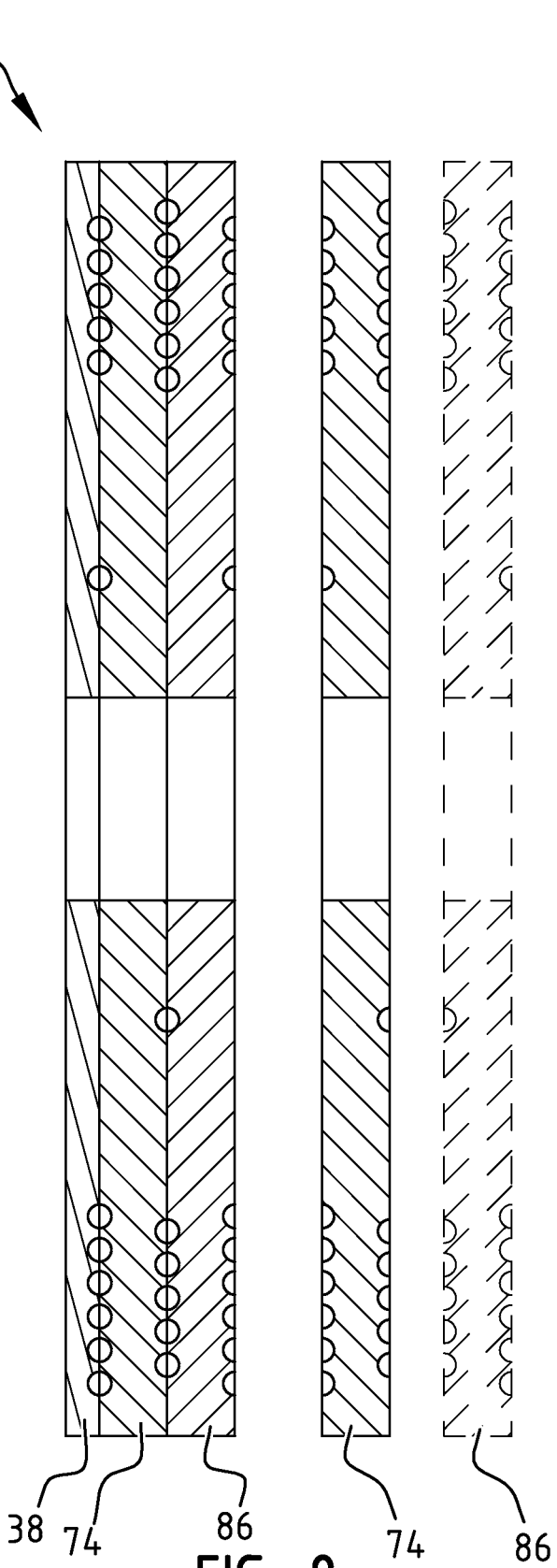
Figure 10:
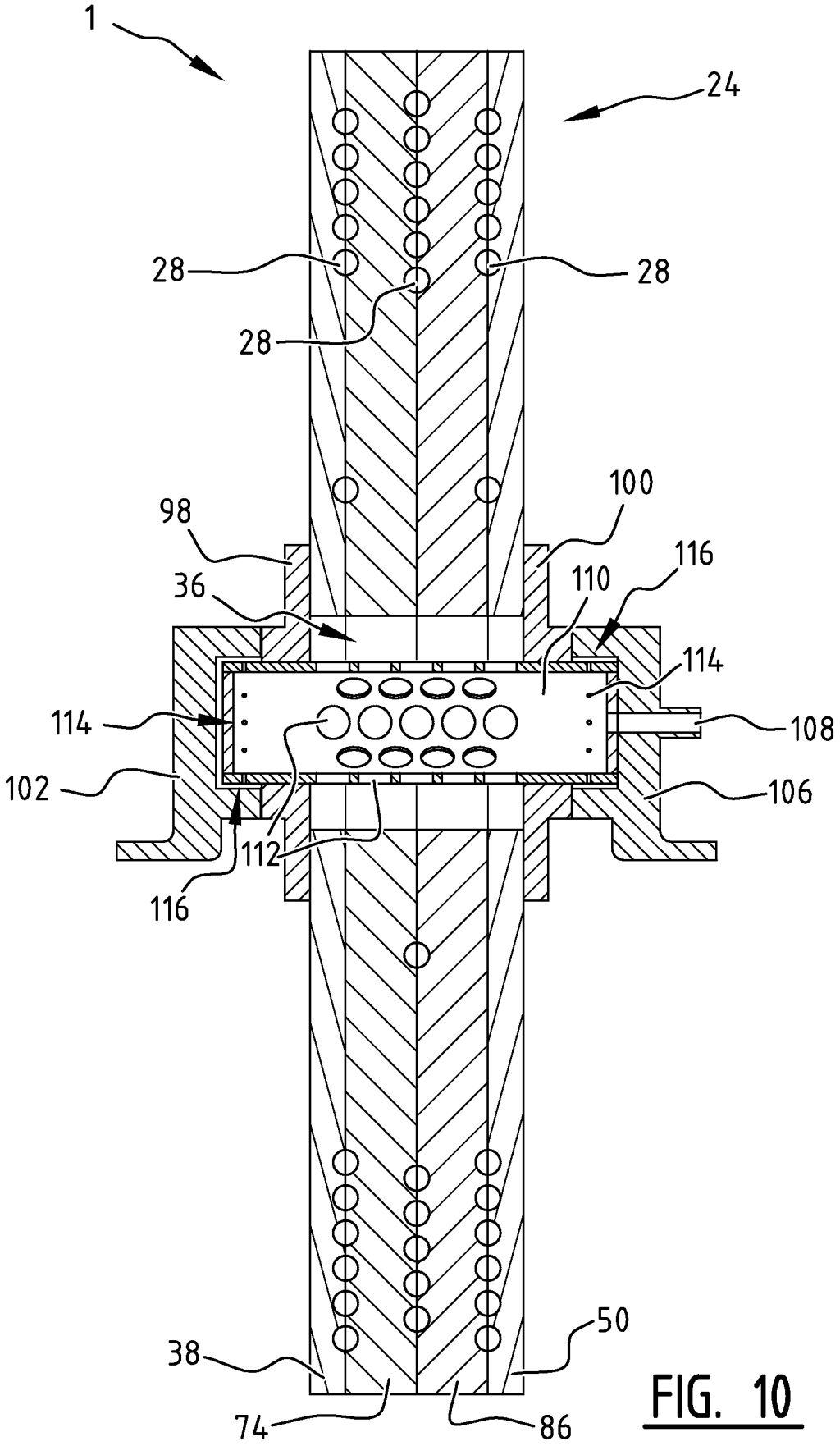
Figure 11:
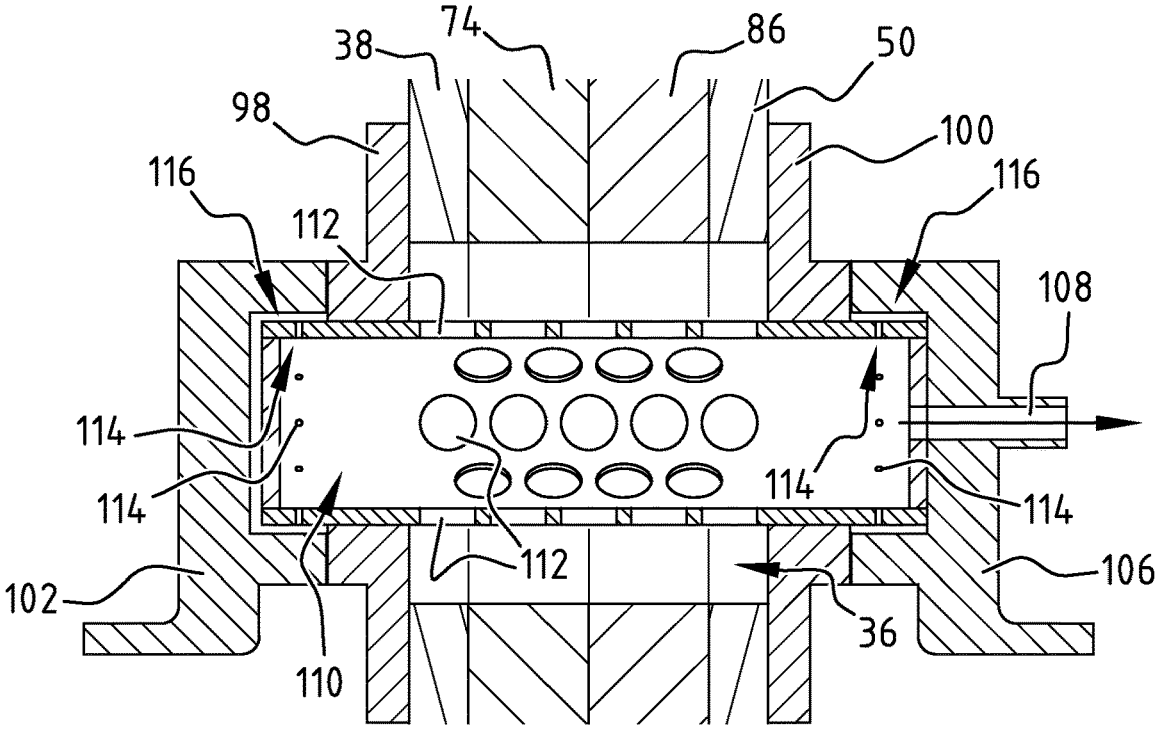
Figure 12:
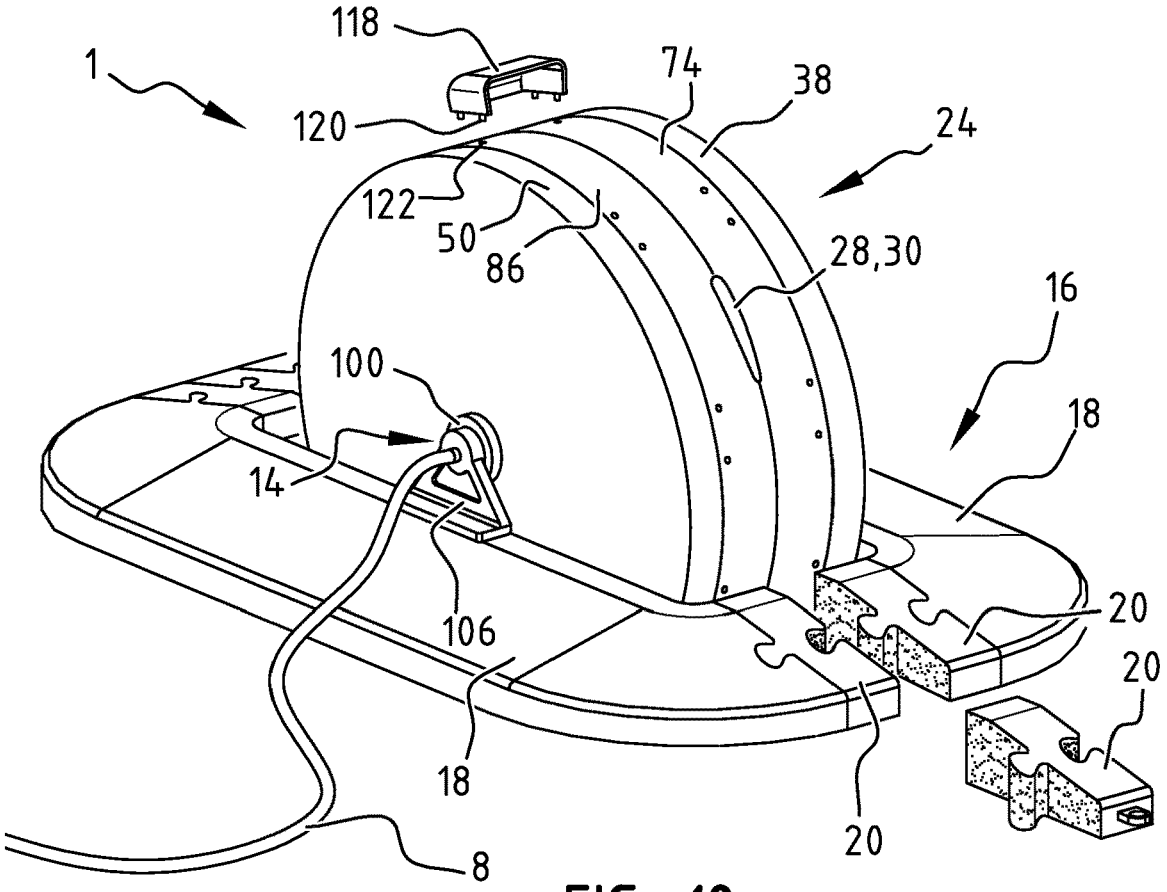
Figure 13:
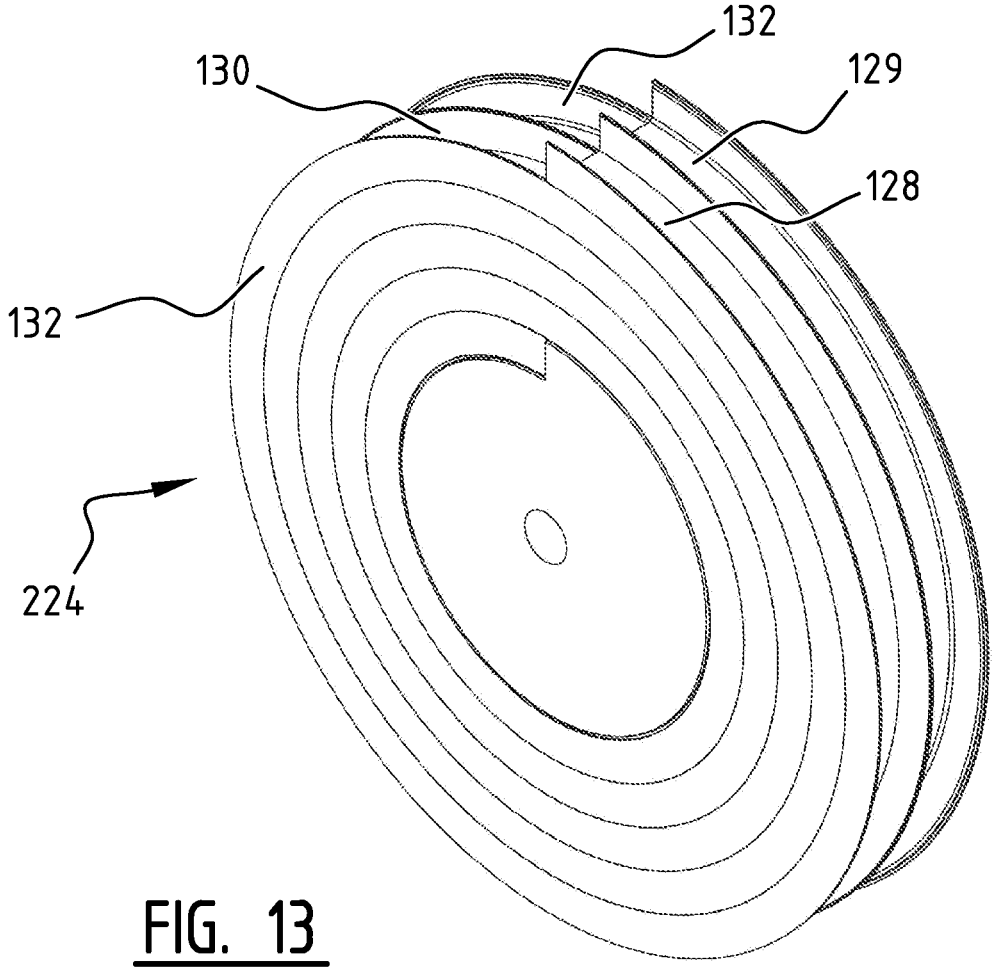
Figure 14:
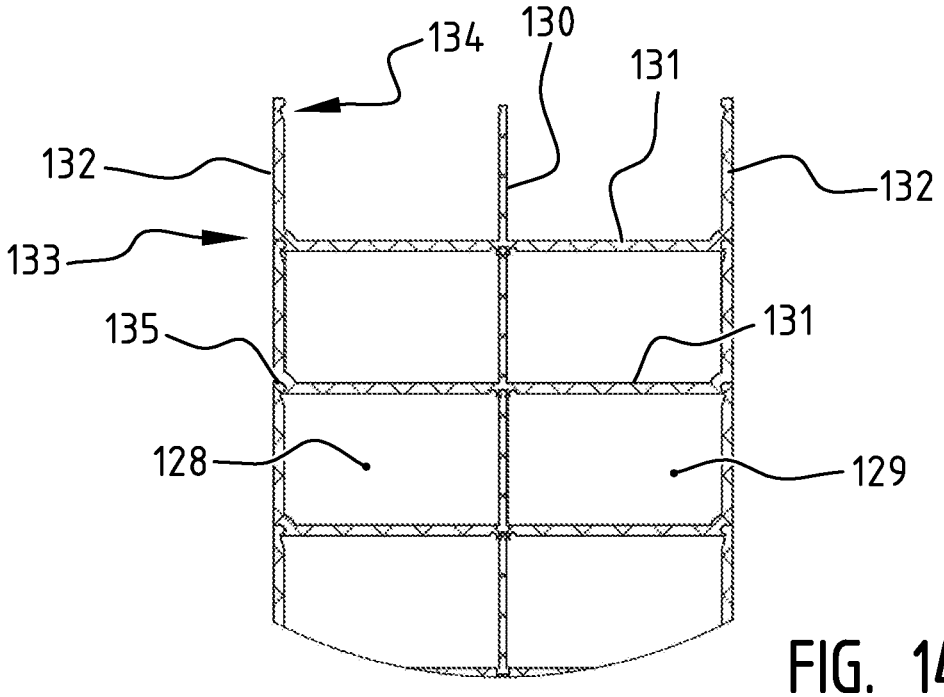

In the following description preferred embodiments of the present invention are further elucidated with reference to the drawing, in which:

FIG. 1: is a perspective view of a spiral pump according to the invention in a water stream;

FIG. 2: is a detailed perspective view of the spiral pump of FIG. 1;

FIG. 3: is a cross sectional view of the spiral pump of FIG. 2;

FIG. 4: is a cross sectional view of the rotary part of FIG. 3 according to a first embodiment;

FIG. 5: is a cross sectional view of the rotary part of FIG. 3 according to a second embodiment;

FIG. 6: is a cross sectional view of the rotary part of FIG. 4 arranged in a support;

FIGS. 7A and 7B: show cross sectional views of a rotary part comprising three sub parts;

FIG. 8: is a cross sectional views of a rotary part comprising four sub parts;

FIG. 9: is a cross sectional views of a rotary part comprising five or more sub parts;

FIG. 10: is a cross sectional view of the rotary part of FIG. 8 arranged with a shaft in a support;

FIG. 11: is a detailed cross sectional view of the shaft and hydrostatic bearing of the embodiment of FIG. 10;

FIG. 12: is a perspective view of a spiral pump comprising a rotary part according to FIGS. 8-11;

FIG. 13: is a perspective view of a spiral pump according to an alternative embodiment; and FIG. 14: is a detailed cross sectional view of the spiral pump of FIG. 13.

FIG. 1 shows a water stream to wherein a spiral pump 1 according to the invention is arranged between poles 4, to which a floating support body 16 of the spiral pump 1 is attached with cables 6. The spiral pump 1 is driven via the water flow of the water stream 2 and the pressurized water is transported via a discharge hose 8 towards an (optional) buffer 10 where it can be stored for later use via a delivery hose 12.

In the shown embodiment, the spiral pump 1 comprises a floating support body 16 that is an assembly of two outer floating parts 18 and an intermediate floating part 20 that connects the both outer floating parts 18. The intermediate floating part 20 comprises a connection eye to which the cable 6 is attachable that can be used for connecting the spiral pump 1 to the poles 4 in the water stream 2.

Arranged on the outer floating parts 18 of floating support body 16 are a first support 102 and a second support 106, only the second support 106 being visible in FIG. 2. The supports 102, 106 support the rigid rotary part 24 that is rotatable around a rotary axis 34.

As shown in FIG. 2, the rigid rotary part 24 comprises an inlet 30 of a spiral fluid channel 28 at its outer radial wall 26. When the streaming water course 2 flows against the paddles 118 that are also arranged on the rigid rotary part 24, the rigid rotary part 24 starts rotating and the inlet 30 of the spiral fluid channel 28 will scoop water out of the water stream 2.

The water and air that are pressurized in the spiral fluid channel 28 of the spiral pump 1 are finally discharged via a discharge hose 8 that is connected to the second support 106 via a rotary coupling 14.

The cross sectional view of FIG. 3 shows how the spiral fluid channel 28 spirals via approximately six convolutions that are arranged in a plane that is substantially transverse to the rotary axis 34. The inlet 30 of the spiral fluid channel 28 is located at the outer radial wall 26 of the rigid rotary part 24, and the outlet 32 of the spiral fluid channel 28 is connected with the pressure chamber 36 near the rotary axis 34 at the center of the rigid rotary part 24.

Approximately five of the shown convolutions of the spiral fluid channel 28 are substantially arranged in the radial area between the outer radial wall 26 of the rigid rotary part 24 and a radius of half the outer radius $r_o$.

FIG. 4 shows the spiral pump 1 of FIGS. 1-3 in a cross sectional view. The rigid rotary part 24 is formed of two substantially rigid sub parts 38, 50.

The outer rotary sub part of the first type 38 is a disc shaped substantially rigid part comprising an outer side 40 and an inner side 42, as well as an outer radial wall 44. Arranged on the inner side 42 is a recess 46 with a spiral shape that mates with a corresponding recess with a spiral shape 58 arranged on the inner side 54 of the outer rotary sub part of the second type 50. The outer rotary sub part of the second type 50 further comprises an outer side 52 and an outer radial wall 56. Both the outer rotary sub part of the first type 38 and the outer rotary sub part of the second type 50 comprise a central opening 48, 60 respectively. These central openings 48, 60 in an assembled state together form (part of) the pressured chamber 36.

When the outer rotary sub parts 38, 50 are assembled, their respective recesses 46, 58 together form the spiral fluid channel 28 that has an outlet 32 in the central openings 48, 60, and hence also the pressure chamber 36.

In the alternative embodiment shown in FIG. 5, two alternative outer rotary sub parts 62, 68 are mated in order form a spiral fluid channel 28 with a flattened cross section with a radial height h and a width w transverse thereto, wherein the radial height h is smaller than the width w. The flattened cross section of the spiral fluid channel 28 shown in FIG. 5 has a rounded shape, more specifically an elliptical shape. Due to the height h of the cross section of the spiral fluid channel 28 being smaller than the width w, it is possible to arrange more convolutions in the same radial distance: FIG. 5 shows seven convolutions in the radial distance where FIG. 4 only comprises five convolutions.

When two or more sub parts are assembled, e.g. the outer rotary sub part of the first type 38 and the outer rotary sub part of the second type 50 that where also shown in FIG. 4, they are arranged between a first flange 98 and a second flange 100 (FIG. 6). The flanges 98, 100 are rotatable around the first support 102 and the second support 106. A hydrostatic bearing 116 is provided because the pressurized fluid in the pressure chamber 36 partly leaks via the contact surface between the flanges 98, 100 and their respective supports 102, 106.

The first support 102 and/or the second support 106 is provided with a fluid passage 104, 108 respectively, for discharging the pressurized fluid from the pressure chamber 36 via the rotary coupling 14 and a discharge hose 8, after which it can be used for different applications.

If the volume output capacity of the spiral pump 1 shown in FIGS. 1-6 is insufficient, the spiral pump 1 according to the invention can be extended using modular parts, as will be shown in FIGS. 7A, 7B, 8 and 9.

In FIGS. 7A and 7B it is shown how a connection rotary sub part of the first type 74 is arranged between an outer rotary sub part of the first type 38 and an outer rotary sub part of the second type 50, i.e. the two sub parts 38, 50 also used for the embodiment shown in FIGS. 1-4 and 6. Compared with this earlier embodiment, the outer rotary sub parts 38, 50 are now rotated relative to each other in order to mate with the connection rotary sub part of the first type 74. This connection rotary sub part of the first type 74 comprises a first side 76, a second side 78, an outer radial wall 80 and a central opening 84. Both the first side 76 and the second side 78 are provided with a spiral shaped recess 82 that mates with the corresponding outer rotary sub part 38, 50. In the assembled state that is shown in FIG. 5, a rigid rotary part 24 is provided that comprises two integrated spiral fluid channels 28 that both have an outlet 32 in their respective central opening 48, 60, 84. Said central openings 48, 60, 84 together form the pressure chamber 36. Please note that the spiral fluid channels 28 are rotated 180° with respect to each other in the embodiment shown in FIGS. 7A and 7B.

According to a further optional arrangement, the fluid that is pressurized in a first spiral fluid channel (e.g. the left spiral fluid channel in FIG. 7A), is fed back to the input of a further spiral fluid channel (e.g. the right spiral fluid channel in FIG. 7A), which allows the head to be increased significantly. In practical tests, a head increase of 70% was achieved. FIG. 8 discloses a rigid rotary part 24 comprising a total of three integrated spiral fluid channels 28. The connection rotary sub part of the first type 74 shown in FIG. 7B and a connection rotary sub part of the second type 86 together form intermediate parts arranged between the outer rotary sub part of the first type 38 and the outer rotary sub part of the second type 50. In the embodiment shown in FIG. 8, the connection rotary sub part of the second type 86 is a mirrored version of the connection sub part of the first type 74 that is arranged adjacent the connection rotary sub part of the second type 86. Again, all central openings 48, 60, 84, 96 together form a pressure chamber 36 wherein all three (not shown) outlets 32 of the spiral fluid channels 28 end. Because all the outlets 32 of the spiral fluid channels 28 end in the same pressure chamber 36, it functions as a pressure equalization chamber.

As shown in FIG. 9, the modular design can be expanded even further using the same sub parts as described above. Please note that successive spiral fluid channels 28 are 180° rotated relative to each other. If it is desirable to have an even more distributed pump delivery, the person skilled in the art will understand that it is possible to provide further (not shown) connection rotary sub parts that are suitable for distributing a number of spiral fluid channels over the total arc of 360°. For example, if three spiral fluid channels 28 are applied, they might be arranged at a relative angle with respect to each other of 120°. Likewise, in case of four fluid channels 28, a relative angle between the fluid channels of 90° might be desirable.

Optionally, a phase cancellation of the outputs of the different spiral fluid channels, as to create a more continuous output flow, may be obtained by providing channels, e.g. flexible tubes, with different lengths between the outlets of the respective spiral fluid channels and the pressure chamber 36 that functions as a mutual output chamber.

The embodiments shown so far only require further connection rotary sub parts 74, 86 to be arranged between the outer rotary sub parts 38, 50 in order to expand the spiral pump 1. However, if the spiral pump 1 is expanded to a larger number of sub parts 38, 74, 86, 50, it might be desirable to incorporate a hollow shaft 110 that is arranged between the first support 102 and the second support 106.

The shaft 110 is provided with fluid passages 112 that allow pressurized fluid from the pressure chamber 36 to enter the hollow casing of the shaft 110, after which it can be transported via a further fluid passage 108 towards a rotary coupling 14 and a discharge hose 8.

Preferably, the shaft 110 comprises further fluid passages 114 near the ends of the shaft 110, via which passages 114 a small amount of pressurized fluid leaves the hollow space of the shaft 110 and functions as a lubrication of the hydrostatic bearing 116 (FIGS. 10 and 11).

When the spiral pump 1 according to the invention is expanded by inserting one or more connection rotary sub parts 86, 74 between the outer rotary sub parts 50, 38, it will also be necessary to adapt the floating support body 16 accordingly. For this reason there are provided a number of intermediate floating parts 20. The intermediate floating parts 20 can be provided with a connection eye 22 that allows the spiral pump 1 to be attached via cables 6 to poles 4 in the water stream 2.

The paddles 118 might comprise pins 120 that fit in receiving holes 122 arranged at the outer radial wall 26 of the rigid rotary part 24. Alternatively, the paddles might be integrated with the rotary part 24.

An alternative embodiment of a rotary part 224 of a spiral pump according to the invention is shown in FIGS. 13 and 14. The embodiment shows a rigid rotary part 224 comprising two spiral fluid channels 128, 129. As can be seen in the cross section of FIG. 14, the rigid rotary part 224 is formed by winding a W-shaped extrusion profile, forming a first spiral fluid channel 128 and a second spiral fluid channel 129 with a dividing wall 130 therebetween.

The skilled person will understand that profiles with alternative shapes, e.g. U-profiles or profiles with a rectangular cross section may be used, but that these will result in 'double' walls, requiring extra material and unnecessarily adding to the weight. Using a W-shaped profile is advantageous for providing a rotary part 224 with two spiral fluid channels 128, 129, as this results in a thin dividing wall 130. If only one spiral fluid channel 128 is to be formed, a U-profile is recommended.

When the extruded profiles are wound, i.e. rolled up, the base 131 of the W-profile forms the closure of an earlier convolution, resulting in closed spiral fluid channels 128, 129.

As shown in FIG. 14, the legs 132 of the W-shaped profile are provided with locking means 133 in the form of protrusions 134 arranged at the outer end of the legs 132. These protrusions 134 are engageable with corresponding recesses 135 that are provided at or near the base 131 of the same profile, either in the base itself or in the legs 132 near the base 131.

According to a further (not shown) embodiment, one or more further dividing walls may be arranged, dividing the spiral fluid channels. The multiple spiral fluid channels that are formed in this way, may be connected in series as explained above, in order to further increase the head of the spiral pump.

Summarizing, the proposed spiral pump 1, provides a reliable construction. Further advantages relative to prior art spiral pumps is the easy (mass) manufacturing, e.g. using injection moulded parts. Furthermore, the construction can be relatively light weight and of limited size. Also, the modular design provides a scalable pump.

Although they show preferred embodiments of the invention, the above described embodiments are intended only to illustrate the invention and not to limit in any way the scope of the invention. For example, the support body is not necessarily a floating support body, but could also comprise a rigid construction.

Accordingly, it should be understood that where features mentioned in the appended claims are followed by reference signs, such signs are included solely for the purpose of enhancing the intelligibility of the claims and are in no way limiting on the scope of the claims.

Furthermore, it is particularly noted that the skilled person can combine technical measures of the different embodiments. For example, the cross sectional shape shown in FIG. 5 might be combined with any of the other embodiments.

The scope of the invention is therefore defined solely by the following claims.

What is claimed is:

1. Spiral pump, comprising:

a support body;

a rigid rotary part having a rotary axis that is rotatable relative to said support body, wherein said rigid rotary part comprises a spiral fluid channel that has an inlet for receiving fluid arranged at or near an outer radial wall of said rigid rotary part and an outlet for discharging fluid at an increased pressure at or near the rotary axis;

wherein a fluid passage, configured for passing fluid at the increased pressure from inside the rigid rotary part to outside the rigid rotary part, is arranged at or near the rotary axis; and fluid engaging members positioned on said rigid rotary part;

wherein the spiral fluid channel is an integrated spiral fluid channel with a course integrated within the rigid rotary part;

wherein the rigid rotary part comprises at least two rigid sub parts opposite relative to the integrated fluid channel, wherein two neighboring mating sub parts in an assembled state are directly connected and recesses in the mating sub parts together form the spiral fluid channel between the mating sub parts.

2. Spiral pump according to claim 1, wherein said spiral fluid channel comprises at least two convolutions that are arranged in a plane that is transverse to the rotary axis.

3. Spiral pump according to claim 2, wherein the outer radial wall of the rigid rotary part has an outer radius $r_o$, and wherein the convolutions are at least arranged in the area between said outer radial wall of the rigid rotary part and a radius of half the outer radius $r_o$.

4. Spiral pump according to claim 3, wherein at least one further convolution of the spiral fluid channel is arranged in the radial distance between half the outer radius $r_o$ and the center of the rigid rotary part.

5. Spiral pump according to claim 1, wherein the spiral fluid channel is formed by spiral shaped recesses arranged at mating radial sides of both neighboring sub parts of the rigid rotary part.

6. Spiral pump according to claim 1, wherein the rigid rotary part comprises a pressure chamber at or near the rotary axis, and wherein the fluid passage is configured for passing fluid at the increased pressure from the pressure chamber to outside the rigid rotary part.

7. Spiral pump according to claim 1, wherein the spiral fluid channel has a substantially flattened cross section with a radial height h and a width w transverse thereto, wherein the radial height h is smaller than the width w.

8. Spiral pump according to claim 1, wherein the spiral fluid channel comprises a narrowing part wherein the cross section decreases in the flow direction.

9. Spiral pump according to claim 8, wherein the spiral fluid channel comprises a widening part wherein the cross section increases in the flow direction, and wherein said widening part is arranged downstream of the narrowing part in said spiral fluid channel.

10. Spiral pump according to claim 1, wherein the spiral fluid channel in the direction away from the inlet divides into multiple fluid channels with a smaller cross sectional area.

11. Spiral pump according to claim 1, further comprising a shaft that is rotatably connected to said support body, said shaft being at least partially hollow and comprising the fluid passage between a pressure chamber in the rigid rotary part and the at least partially hollow shaft configured for passing fluid at the increased pressure from the pressure chamber to outside the rigid rotary part.

12. Spiral pump according to claim 1, wherein the support body is a floating support body that is configured to be partially submerged in a fluid.

13. Spiral pump according to claim 1, wherein the fluid engaging members comprise paddles.

14. Spiral pump, comprising:

a support body;

a rigid rotary part having a rotary axis that is rotatable relative to said support body, wherein said rigid rotary part comprises a spiral fluid channel that has an inlet for receiving fluid arranged at or near an outer radial wall of said rigid rotary part and an outlet for discharging fluid at an increased pressure at or near the rotary axis;

wherein a fluid passage, configured for passing fluid at the increased pressure from inside the rigid rotary part to outside the rigid rotary part, is arranged at or near the rotary axis; and fluid engaging members positioned on said rigid rotary part;

wherein the spiral fluid channel is an integrated spiral fluid channel with a course integrated within the rigid rotary part, further comprising at least one further spiral fluid channel, wherein the spiral fluid channel and the further spiral fluid channel are connected in series by providing a fluid connection between an inner convolution at a first outlet radius of the spiral fluid channel and an outer convolution at a second inlet radius of the further spiral fluid channel, wherein the second inlet radius is larger than the first outlet radius.

* * * * *